US007857106B2

(12) United States Patent
Zapf

(10) Patent No.: US 7,857,106 B2
(45) Date of Patent: Dec. 28, 2010

(54) VERTICAL POSITION DETECTION OF A SUSPENDED ELEVATOR CAR

(75) Inventor: Volker Zapf, Obernau (CH)

(73) Assignee: Inventio AG, Hergiswil NW (CH)

( * ) Notice: Subject to any disclaimer, the term of this patent is extended or adjusted under 35 U.S.C. 154(b) by 614 days.

(21) Appl. No.: 11/871,505

(22) Filed: Oct. 12, 2007

(65) Prior Publication Data

US 2008/0087502 A1 Apr. 17, 2008

(30) Foreign Application Priority Data

Oct. 12, 2006 (EP) ..... 06122159

(51) Int. Cl.
*B66B 1/34* (2006.01)

(52) U.S. Cl. ..... 187/394

(58) Field of Classification Search ..... 187/391–394, 187/287, 288; 73/490, 493
See application file for complete search history.

(56) References Cited

U.S. PATENT DOCUMENTS 6,454,054 B1 * 9/2002 Tanino et al. ..... 187/394
6,651,781 B2 * 11/2003 Lindegger et al. ..... 187/394
7,540,357 B2 * 6/2009 Finn et al. ..... 187/394
2003/0057031 A1 * 3/2003 Gottlieb et al. ..... 187/394

FOREIGN PATENT DOCUMENTS

| | | | |
|---|---|---|---|
| DE | 195 14 801 | A1 | 10/1996 |
| DE | 10 2004 047158 | A1 | 3/2006 |
| EP | 1 278 693 | B1 | 12/2003 |
| EP | 1 530 040 | A | 5/2005 |
| EP | 1 550 629 | A1 | 7/2007 |
| WO | WO 2004/106208 | A1 | 12/2004 |
| WO | WO 2004/106209 | A | 12/2004 |
| WO | WO 2006/099770 | A | 9/2006 |

* cited by examiner

*Primary Examiner*—Jonathan Salata
(74) *Attorney, Agent, or Firm*—Fraser Clemens; Martin & Miller LLC; William J. Clemens

(57) ABSTRACT

A system for detecting the position of an elevator car includes a belt at which the elevator car is suspended and a detector for detecting the position of the belt, wherein the belt has on a first side a toothing in which a gearwheel of the detector mechanically positively engages.

12 Claims, 2 Drawing Sheets

VERTICAL POSITION DETECTION OF A SUSPENDED ELEVATOR CAR

FIELD OF THE INVENTION

The present invention relates to a system and a method for detecting the position of an elevator car.

BACKGROUND OF THE INVENTION

In order to move an elevator car in an elevator shaft between different positions the car is suspended at a flexible supporting and/or drive means. In most recent times belts, apart from conventional steel cables, have also established themselves as supporting and/or drive means, which belts, for example, couple the elevator car with the counterweight and/or transmit a traction force for raising and lowering the car.

Knowledge of the position of the elevator car, thus its position in the elevator shaft, is required for control of the car. The speed or acceleration of the elevator car can also be determined from the position by differentiation according to time and can be similarly used in the control (for example the starting off or braking process or in the monitoring of a maximum speed/maximum acceleration), but also for, for example, determination of the actual car total weight as a quotient of force, which is exerted on the car by a drive means, and the resulting acceleration.

In order to determine the position of the elevator car, EP 1 278 693 B1 proposes a rotation transmitter which is arranged at the elevator car and which co-operates in mechanically positive manner with a separate cogged belt stretched in the shaft. This proposal requires, in disadvantageous manner, an additional cogged belt.

WO 2004/106208 A1 therefore proposes coding the support belt itself and detecting the position thereof by means of a detector arranged in the elevator shaft. The codings shall, according to the specification, preferably be realized by a magnetic material embedded in the belt, by changes (particularly enlargements) of wires arranged in the belt or by an additional cable in the belt and shall be contactlessly detected by an appropriate detector. WO 2004/106209 A1 expressly advises against grooves in the belt due to noise problems.

In the detection of the coding, as is proposed in WO 2004/106209 A1, the belt not only moves in correspondence with the movement of a elevator car, but can additionally move relative to the detector due to longitudinal, transversal and/or torsional oscillations induced by, for example, system inertias, movements of the car occupants or stick/slip effects in the guidance of the elevator car. Such additional movements of the belt are falsely detected by the detector as positional changes of the elevator car and falsify the positional determination. These errors amplify when the speeds or even accelerations are determined from the positions.

A further disadvantage of the system known from WO 2004/106209 A1 consists in that the proposed detectors, particularly optical or magnetic systems, need electrical energy and thus are no longer functionally capable in the event of damage, for example a fire, so that it is no longer possible to safely move the elevator car, with its help, to a predetermined position (for example an emergency disembarking position at the next storey or the ground floor), for example through the elevator being manually driven.

Finally, the systems proposed in WO 2004/106209 A1 are not optimal for the environmental conditions prevailing in an elevator shaft, particularly contamination or wear of the belt, since on the one hand the magnetic or optical coding can be diminished and on the other hand the sensitive detectors necessary for detection thereof can be damaged.

Proceeding from WO 2004/106209 A1 it is therefore an object of the present invention to provide a system and a method for detection of the position of an elevator car which is not impaired or is impaired only slightly by oscillations of the belt.

SUMMARY OF THE INVENTION

A system for detection of the position of an elevator car according to the present invention comprises a belt, at which the elevator car is suspended, and a detector for detection of the position of the belt. According to the present invention the belt has on a first side a toothing in which a gearwheel of the detector mechanically positively engages.

Longitudinal oscillations in belt longitudinal direction, torsional oscillations about the belt longitudinal axis and transversal oscillations in the direction of the belt transverse axis thereby do not prejudice, or prejudice only slightly, the detected position of the belt, since on the one hand they are damped or even prevented by the mechanically positive engagement of the gearwheel in the toothing of the belt and on the other hand a relative movement of the belt in a direction other than the rolling direction of the toothing, such as occurs with the aforesaid torsional or transversal oscillations, does not cause any change or causes only a slight change in the angular position of the gearwheel.

In addition, the mechanical, form-coupled measurement of the belt position by means of the gearwheel does not necessarily require electrical energy. A system according to a preferred embodiment of the present invention therefore allows determination of the belt position even in the case of energy failure, for example as a consequence of a fire situation, and thus enables manual controlling of the elevator car to an emergency disembarking position.

The gearwheel mechanically measuring the belt position can therefore be substantially more resistant relative to the environmental conditions prevailing in the elevator shaft, particularly dirt, moisture and the like, than known optical or magnetic detectors. Beyond that it is also not disturbed by electrical or magnetic fields such as can occur, for example, in the vicinity of an electric motor elevatoring the elevator car. Moreover, changing light conditions, for example when switching on warning lamps in the elevator shaft, do not, by contrast to optical systems, influence the positional detection by means of a gearwheel.

By "toothing" there is understood primarily an arrangement of alternating projections (teeth) and depressions (tooth gaps) which extend partly in the direction of the belt transverse axis, particularly straight, inclined, double or multiple toothings, wherein the individual projections and the toothings preferably complementary therewith in the toothing or the gearwheel can have, for example, a circularly segmental, cycloidal or involute cross-section. Such toothings, particularly helical toothings or toothings with involute or round teeth, can advantageously reduce the belt oscillations and noises occurring in operation. They can also make possible a particularly precise positional determination.

Preferably a tensioning element such as, for example, one or more guide rollers or a tensioner loaded by spring force can bias the belt against the gearwheel and thus ensure the mechanically positive engagement. Oscillations of the belt, which impair the positional determination, can thereby be further reduced or entirely suppressed.

The belt can comprise several cables or strands of singly or multiply twisted wires and/or synthetic material threads, which serve as tensile carriers and which are encased by a belt body, for example of a resilient synthetic material. The toothing can in that case be constructed by primary forming of this synthetic material encasing. In a preferred development the synthetic material encasing can for this purpose comprise one or more layers, which have the toothing, of a different material, particularly of a different synthetic material, which is preferably hard, stable in shape and/or wear-resistant.

In a preferred embodiment the gearwheel is coupled with a rotation transmitter, particularly an incremental rotation transmitter or an angle coder, which issues a position signal corresponding with the absolute or relative angular position. A rotation transmitter for output of a position signal corresponding with the relative angular position can be constructed particularly simply, economically and/or robustly. The absolute position of the car can also be indirectly determined with such a rotation transmitter by summating the complete revolutions.

Advantageously use can also be made of a rotation transmitter which directly indicates the absolute angular position, thus the number of (part) revolutions of the gearwheel from a zero position. Thus, for example, a strip wound up on the axle of the rotation transmitter can indicate the absolute position of the belt. Equally, the gearwheel can be coupled with the rotation transmitter by way of a speed step-up transmission so that a complete revolution of the rotation transmitter corresponds with several revolutions of the gearwheel. With particular advantage, the rotation transmitter can use a Gray coding. In a particularly preferred embodiment the rotation transmitter comprises a multi-turn rotation transmitter containing two or more code discs which each have one or more parallel code tracks and which are coupled together by way of a speed step-down transmission, in order to determine the absolute angular position.

The output of the absolute angular position has the advantage that no positions, in particular the previously executed complete revolutions of the gearwheel, have to be stored. Thus, for example, after a power failure the position of the belt can be directly determined by recognition of the absolute angular position without having to initially move again to a reference position.

Mixed forms are also possible in which, for example, the rotation transmitter indicates the position of the belt starting out from a respective floor, i.e., after movement of the car by one floor, again indicates the same position. The absolute position of the belt or the car can then again be determined in a processing logic system by summation of the floors covered. In the event of damage it can then be sufficient to determine the position of the car relative to the closest floor door in order to securely move the car to an emergency disembarking position.

A system according to the present invention can further comprise a processing unit for determination of the position of the elevator car from the position signal. As explained in the foregoing, this can obtain the absolute or relative angular position from the rotation transmitter. Denoted as angular position in that case is the rotation modulo $2\pi$ executed by the gearwheel or rotation transmitter, whilst the absolute angular position denotes the entire rotation which is executed relative to a reference position and which therefore can also be a multiple of $2\pi$.

For placing the system in operation this is preferably calibrated, wherein the processing unit stores, in particular, a reference position of the belt. Proceeding from this reference position the processing unit then determines a theoretical position of the elevator car from the absolute angular position of the rotation transmitter by multiplying this by, for example, the reference circle radius of the gearwheel. If the processing unit receives only a relative angular position, then it adds up the executed complete revolutions and adds this to the relative angular position before it again multiplies this sum by the reference circle radius of the gearwheel.

The belt can be articulated, i.e. fastened or deflected, to the elevator car in the form of, for example, a block-and-tackle with step-up or step-down translation so that a positional change of the belt does not directly correspond with a positional change of the elevator car. If, for example, the belt is articulated to the elevator car by way of a free roller, then the processing unit halves the position signal or the position change of the belt before it calculates therefrom the position of the elevator car in the shaft.

Apart from these systematic differences between the position of the belt and the elevator car still further deviations can occur if the belt, for example, stretches in the longitudinal direction due to static or dynamic loads. In a preferred development the processing unit therefore comprises a correction unit for correction of the position signal. In this connection, for example, correction values which take into consideration the actual weight of the elevator car, the stretching of the belt occurring in that case or the like can be stored as tabular values. If, for example, it is established by a device for detection of the actual car weight that this corresponds with the maximum permissible total weight and it is known from tests or calculations that the belt then stretches by 10% by comparison with the nominal weight then the correction unit corrects the theoretical car position, which is determined by the processing unit on the basis of the angular position, by 10%.

Equally, a car position determined by a further measuring device such as, for example, a contact switch, which is triggered by the elevator car, can also be taken into consideration in the correction of the positional determination. Thus, for example, the offset between the theoretical car position, which is calculated on the basis of the position of the belt by the processing unit, and the actual car position, which is detected by such a measuring device, which offset can result from, for example, stretching of the belt, can be detected in the correction unit and stored. The car positions determined by the processing unit can subsequently be corrected by this stored offset, wherein advantageously this offset value is updated in each instance as soon as a new car position has been detected by the further measuring device.

According to a preferred form of embodiment the belt has a second side which is remote from the first side and by way of which the belt is driven by a drive wheel or drive shaft by friction couple.

In a particularly preferred embodiment the belt has on its second side at least one wedge rib, which is oriented in belt longitudinal direction, or a planar surface, by way of which the belt is disposed in contact with the drive wheel or with the drive shaft. The same drive capability can advantageously thereby be realized with a lower belt tension. In the case of such lower belt tensions stronger belt oscillations arise which disadvantageously prejudice the positional determination with conventional detectors. The combination according to the invention of a toothing on the first belt side with wedge ribs on the second belt side does, however, permit determination of the position of the belt which, as explained in the foregoing, is less impaired by such belt oscillations. Advantageously such wedge ribs laterally guide the belt on the driving or deflecting wheels. Sideways movements of the belt are thereby prevented and a problem-free positional detection is made possible by the detector.

In a particularly preferred embodiment the toothing can be formed on a first side of a flat belt opposite a second side which comes into engagement or contact with at least one driving and/or deflecting wheel. It is thus possible to realize a relatively wide toothing which is more insensitive with respect to displacements, which occur transversely to the toothing, relative to the gearwheel of the detector. In addition, the driving and/or deflecting wheels tighten the belt against the toothing and thus increase the reliability and precision of the tooth engagement.

Alternatively, the toothing can also be formed at a narrow side of the flat belt, which is preferably oriented approximately at right angles to a side coming into engagement with one or more driving and/or deflecting wheels. Since a flat belt is stiff in its transverse direction, due to the higher area moment of inertia, relative to bendings such a toothing can be more stable in shape so that deformations of the belt, which would prejudice the positional determination, are less.

Finally, the belt, which is preferably constructed as a flat belt, can also come into engagement or contact by its first side, which has the toothing, with at least one of the driving and/or deflecting wheels. The second side opposite the first side can, for reduction in the friction on deflecting wheels, be flat or similarly have a profile for guidance in driving or deflecting wheels, for example similarly have a toothing or one or more wedge ribs. The belt can come into engagement only by its first side, which has the toothing, or only by its second side opposite thereto, which preferably has wedge ribs, or by its first and second sides with one or more driving and/or deflecting wheels.

In a particularly preferred embodiment the belt always loops around an arrangement of deflecting and/or driving wheels by the same second side opposite the first side, so that its first side, which carries the toothing, does not come into contact with these deflecting and/or driving wheels. This preserves the toothing and thus increases the service life of the system.

The belt can, particularly for this purpose, be twisted about its longitudinal axis between two wheels of the arrangement of deflecting and/or driving wheels. If, for example, the belt loops around two successive wheels in the same plane, but in directions of opposite sense, the belt can be twisted through 180° about its longitudinal axis between these two wheels so that it loops around the two wheels by the same (second) side. If the axes of the two successive wheels are not, thereagainst, parallel, but, for example, oriented at right angles to one another then the belt can be twisted through the appropriate angle, in this case thus 90°.

Deflecting wheels which, in particular, do not introduce tension forces into the belt, but only guide this, can also come into engagement with the first side, which is provided with the toothing, of the belt, since on the one hand the toothing is thereby hardly loaded, but on the other hand, particularly, for example, in the case of a double helical toothing, the belt is also sufficiently guided in transverse direction.

In an embodiment of the present invention the detector is arranged inertially fixed in an elevator shaft in which the elevator car moves. This has the advantage that the position signals generated by the detector can be transmitted in simple manner to an inertially fixed elevator control.

In the event of failure of the electrical energy supply a detector provided in accordance with the invention with a gearwheel, which mechanically positively co-operates with the belt and mechanically measures the position thereof, preferably also enables positional determination without electrical energy and thus a manually driven displacement of the car to an emergency disembarking position. Thus, for example, in the event of power failure a drive wheel at the drive engine can, for evacuation of passengers, be manually rotated, whilst a detector, which also visually indicates the position, is observed. Such a detector preferably indicates the absolute position of the belt. Through observation of this detector it can be established, in the case of an evacuation, when the manually raised or lowered car has reached a predetermined emergency disembarking position (for example, at the ground floor).

The gearwheel is preferably arranged in inertially fixed manner between a drive wheel and the suspension of the elevator car so that stretchings of the belt in the region of the counterweight do not impair the positional determination.

In another embodiment of the present invention the detector is arranged at the elevator car. Thus, the position can be made available directly in the elevator car. On the other hand, the belt is usually guided at the elevator car by one or more guide rollers, by which it can advantageously be biased against the gearwheel.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
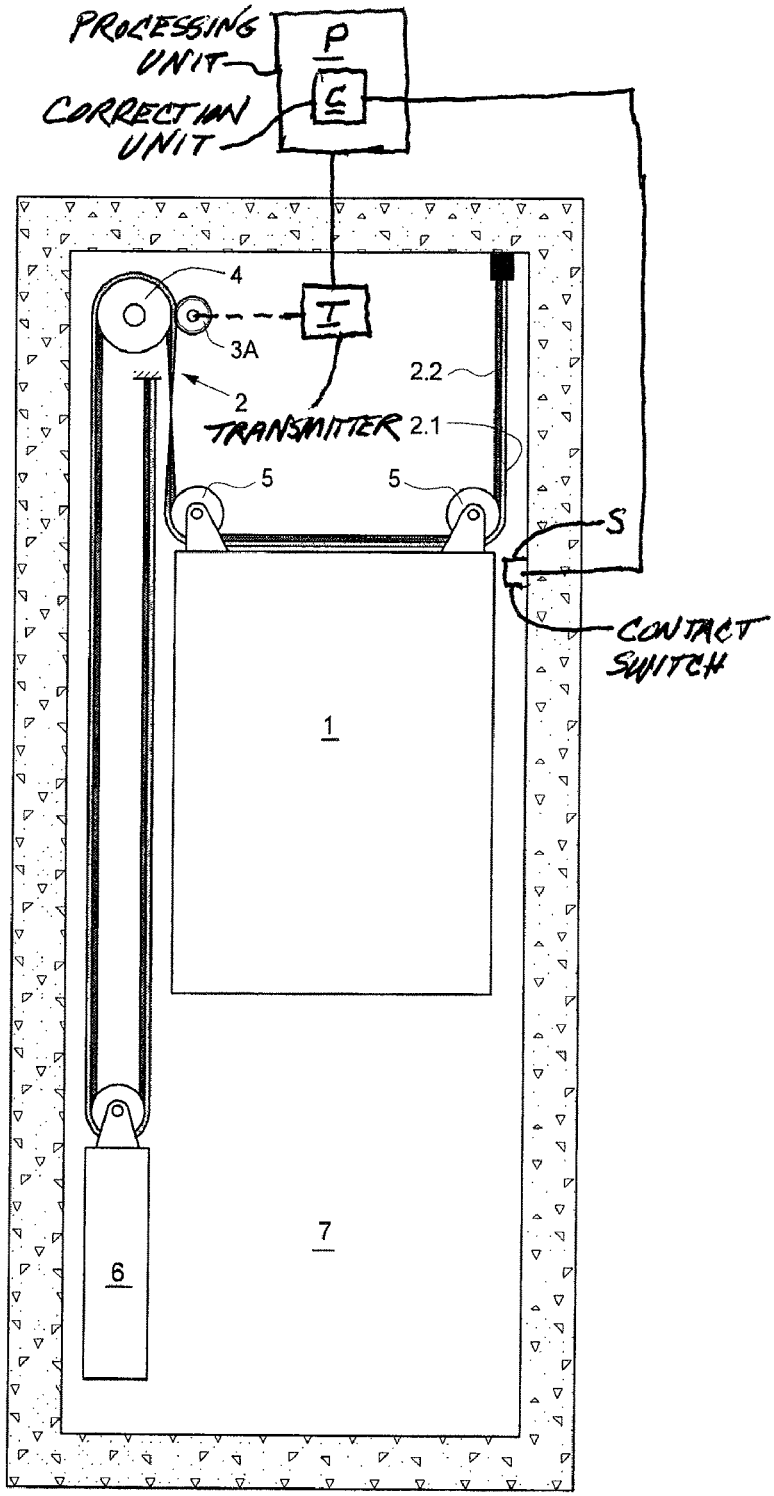
FIG. 1 is a schematic elevation view of an elevator installation with a system for detection of the position of an elevator car, according to a first embodiment of the present invention.

FIG. 1 shows an elevator installation with an elevator car 1 vertically movable in a shaft 7. For raising and lowering the car a belt 2 is fastened at one end thereof in the elevator shaft and runs from there over two deflecting wheels 5, which are arranged at the roof of the car 1, and a drive wheel 4, which is driven by an electric motor (not illustrated), to a deflecting wheel at a counterweight 6.

The belt 2 is constructed as a flat belt, in which several wire cables as tensile carriers are arranged in a belt body of polyurethane. It loops around the drive wheel 4 and the deflecting wheels 5 by a second flap side 2.2 (shaded in FIG. 1). This side has several wedge ribs which extend in belt longitudinal direction and which are in engagement with complementary grooves in the drive wheel 4 and the deflecting wheels 5. The belt tension can thereby be significantly reduced and at the same time a sufficient drive capability of the drive wheel 4 ensured.

Since the belt loops around the drive wheel 4 and the adjacent wheel 5 in opposite sense (in FIG. 1 the belt 2 is, going out from the counterweight 6, bent around the drive wheel 4 negatively in mathematical sense and around the adjacent deflecting wheel 5 positively in mathematical sense), the belt 2 is twisted about its longitudinal axis through 180° between these two wheels 4, 5 so that in each instance its second, flat side 2.2, which is provided with the wedge ribs, comes into engagement with the guide surfaces of the wheels 4, 5.

A toothing in which a gearwheel 3A of a detector (not illustrated) engages is formed on the first flat side 2.1 (illustrated bright in FIG. 1), which is opposite the second flat side 2.2, of the belt 2. The gearwheel 3A is fixed in the elevator shaft 7 in the vicinity of the drive wheel 4 so that the belt 2 is guided by the drive wheel 4 and the gearwheel 3A. If gearwheel and drive wheel are arranged sufficiently closely adjacent to one another, in particular separated only by a gap which substantially corresponds with the belt thickness, then the drive wheel 4 advantageously presses the belt onto the gearwheel 3A and thus prevents jumping-over of teeth, which improves the precision of the positional detection.

The gearwheel 3A is connected with a rotation transmitter T which determines the relative angular position of the gearwheel, i.e. the rotation modulo $2\pi$ thereof, and delivers a corresponding signal to a processing unit P. This determines the absolute position of the belt 2 by adding the complete revolutions, which have already taken place, in correspondence with its sign (i.e. subtraction of revolutions in opposite sense) by multiplying the resulting total angle (relative angular position plus complete revolutions) by the reference circle radius of the gearwheel 3A. The processing unit subsequently halves this value for the purpose of consideration of the block-and-tackle arrangement of the belt 2 and determines therefrom the position of the car 1 in the shaft 7.

Each time the car 1 actuates a contact switch S arranged in the vicinity of the shaft door a correction unit C detects this actual position of the car 1 and compares with the theoretical value ascertained from the belt position. If the value ascertained from the belt position deviates—for example, due to belt stretching or a jumping-over of the toothing in the gearwheel 3A—from the thus-determined actual position of the car 1 then the correction unit C stores this deviation and subsequently adds it to the theoretical car position determined from the gearwheel position.

Since the belt position is determined relatively precisely and with high resolution by the mechanical derivation it is possible to also precisely determine the speed or acceleration of the belt by simple or double differentiation over time, wherein, in particular, an unchanging belt extension can be left out of consideration. This allows monitoring of maximally occurring speed and acceleration values, running down of predetermined speed profiles and estimation of the car total mass from the quotient of the tension force, which is exerted by the drive wheel 4 on the belt 2, and the resulting acceleration.

Figure 2:
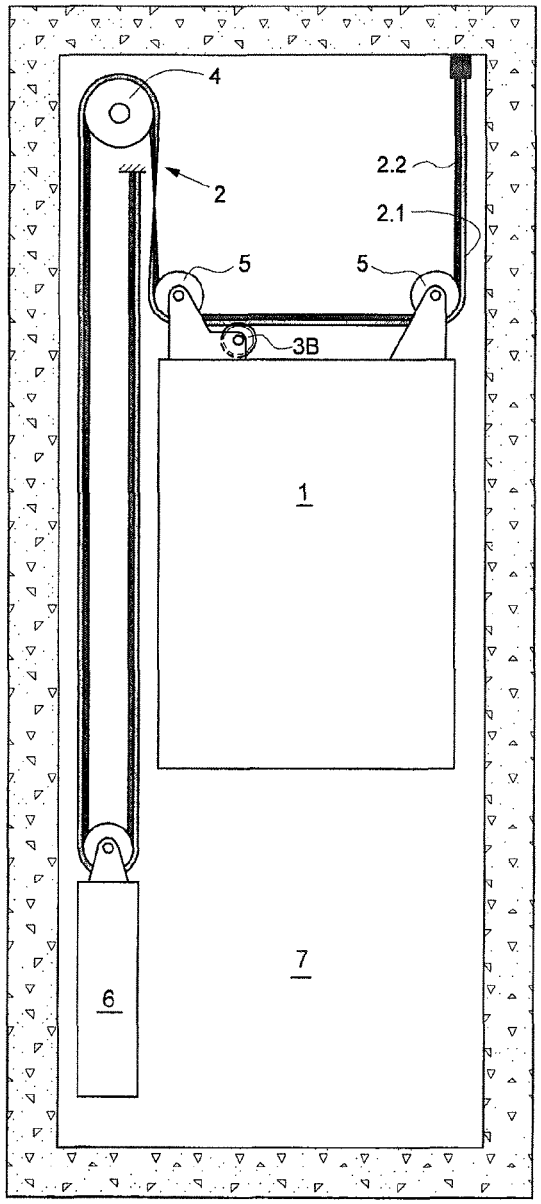
FIG. 2 is a schematic elevation view of an elevator installation with a system for detection of the position of a elevator car, according to a second embodiment of the present invention.

FIG. 2 shows an elevator installation with a system for detecting the position of an elevator car according to a second embodiment of the present invention in an illustration corresponding with FIG. 1. The same elements are in that case provided with corresponding reference numerals, so that reference can be made to the preceding description for explanation thereof and only the differences from the first embodiment are discussed in the following.

In the second embodiment a gearwheel 3B is rotatably arranged at the car 1 and engages in the toothing on the first side 2.1 of the belt 2 in the vicinity of one of the deflecting wheels 5, so that the belt is additionally guided between the deflecting wheel 5 and the gearwheel 3B.

The gearwheel 3B is coupled by way of a step-down transmission with a rotation transmitter (T in FIG. 1) in such a manner that a movement of the elevator car 1 between an uppermost and a lowermost maximum possible position, during which the gearwheel 3B executes several complete revolutions, just corresponds with a complete revolution of an encoding disc. Thus, the absolute angular position of the encoding disc directly reproduces the absolute position of the belt 2 from which, as in the case of the first embodiment, the position of the car 1 can be determined.

Figure 3:
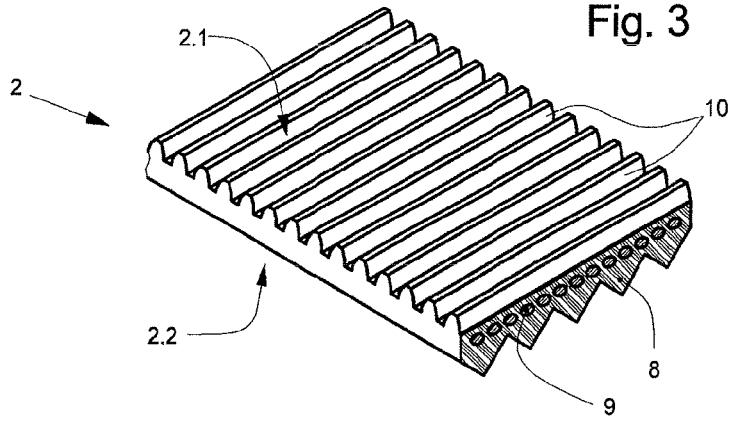
FIG. 3 is a perspective view of a section of a belt according to the present invention usable for detection of the position of the elevator car.

FIG. 3 shows a section of the afore-described belt 2 serving as a supporting and drive means for the elevator car 1 as well as for detection of the position thereof. The belt has substantially the form of a flat belt. This has, on the first side 2.1, a toothing 10 with teeth which are oriented transversely to its longitudinal direction and in which—as illustrated in FIGS. 1 and 2—a gearwheel of the detector mechanically positively engages. The belt has on its second flat side 2.2 several wedge ribs 8 which extend in the belt longitudinal direction and which come into engagement with complementary grooves in the drive wheel 4 and the deflecting wheels 5. Tensile carriers which are integrated in the belt body of the belt 2 and are preferably executed as wire cables or synthetic fiber cables are denoted by reference numeral 9. The tensile carriers are required because the strength of the belt body is not sufficient to transmit the tension forces arising in the belt.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A system for detecting the position of an elevator car suspended by a belt comprising:

a belt from which the elevator car is suspended, said belt having a toothing formed on a first side and a second side which is opposite said first side for driving said belt by friction couple, said belt being twisted about a longitudinal axis thereof through 180° between two wheels of an arrangement of deflecting wheels and a drive wheel contacting said second side to maintain said first side out of contact with the arrangement of the deflecting wheels and the drive wheel; and a detector mounted adjacent to said belt and having a gearwheel mechanically engaging said toothing.

2. The system according to claim 1 wherein said gearwheel is coupled with a rotation transmitter generating a position signal corresponding with an absolute or relative angular position of said gearwheel.

3. The system according to claim 2 including a processing unit connected to said rotation transmitter for determining a position of the elevator car from said position signal.

4. The system according to claim 3 wherein said processing unit includes a correction unit for correction of said position signal.

5. The system according to claim 1 wherein said belt has on said second side at least one wedge rib or a planar surface for contact with the drive wheel or the drive shaft.

6. The system according to claim 1 wherein said belt loops around the arrangement of the deflecting wheels and the drive wheel in contact with said second side.

7. The system according to claim 1 wherein said belt is twisted about the longitudinal axis through 180° between one of the deflecting wheels of the arrangement and the drive wheel.

8. The system according to claim 1 wherein said detector is inertially fixed in an elevator shaft in which the elevator car moves.

9. The system according to claim 1 wherein said detector is arranged at the elevator car.

10. A method for detecting the position of the elevator car by the system according to claim 1, comprising the steps of: a. detecting an angular position of the gearwheel; and b. determining the position of the elevator car from the angular position.

11. A system for detecting the position of an elevator car suspended by a belt comprising:

a belt from which the elevator car is suspended, said belt having a toothing formed on a first side, said belt being twisted about a longitudinal axis thereof through 180° between a deflecting wheel and one of another deflecting wheel and a drive wheel to maintain said first side out of contact with the wheels; and a detector mounted adjacent to said belt and having a gearwheel mechanically engaging said toothing.

12. The system according to claim 11 wherein said belt has a second side which is opposite said first side for driving said belt with the drive wheel or a drive shaft by friction couple.

* * * * *